United States Patent [19]

Sheridan

[11] Patent Number: 5,034,588

[45] Date of Patent: Jul. 23, 1991

[54] INDUCTION SHAFT HEAT TREATMENT APPARATUS

[75] Inventor: Martin P. Sheridan, Saginaw, Mich.

[73] Assignee: General Motors Corporation, Detroit, Mich.

[21] Appl. No.: 562,060

[22] Filed: Aug. 2, 1990

[51] Int. Cl.[5] ..... H05B 6/14

[52] U.S. Cl. ..... 219/10.57; 219/10.69; 219/10.73; 219/10.75; 266/129; 148/150

[58] Field of Search ..... 219/10.57, 10.75, 10.77, 219/10.69, 10.67, 10.73; 266/124, 125, 127, 128, 129; 148/145, 150, 154

[56] References Cited

U.S. PATENT DOCUMENTS

| | | | |
|---|---|---|---|
| 2,202,759 | 5/1940 | Denneen et al. | 148/10 |
| 2,264,301 | 12/1941 | Denneen et al. | 266/4 |
| 2,511,059 | 6/1950 | Haynes | 266/4 |
| 3,555,233 | 1/1971 | Pfaffman et al. | 219/10.59 |
| 3,622,138 | 11/1971 | Kostyal | 255/5 |
| 3,743,808 | 7/1973 | Kasper | 219/10.41 |
| 3,823,927 | 7/1974 | Budzinski | 219/10.57 |
| 3,988,179 | 10/1976 | Del Paggio et al. | 219/10.57 |
| 4,459,451 | 7/1984 | Regele | 219/10.57 |

*Primary Examiner*—Philip H. Leung

*Attorney, Agent, or Firm*—Douglas D. Fekete

[57] ABSTRACT

Shaft heat treatment apparatus includes a heat treatment station having a path through which a shaft travels in an axial direction while rotating for heat treating successive axial increments thereof. The shaft is supported by a pair of opposing support jaws at one or more shaft locations intermediate the shaft ends to reduce shaft warpage during heat treatment. The support jaws are transversely movable between shaft-engagement positions and open positions that allow passage of the shaft location through the station. Cam surfaces disposed in proximity to the treatment station engage cam follower surfaces of the support jaws as each pair of support jaws approaches the treatment station to urge the support jaws from the shaft-engagement positions to the open positions to bypass the station without colliding therewith. After the axial shaft location engaged by each pair of support jaws exits the station, the cam/cam follower surfaces allow return of the support jaws to the shaft-engagement position to re-engage the axial shaft location. As a result, each pair of support jaws confines the shaft therebetween at an axial location both before and after bypassing the station to substantially reduce shaft warpage during heat treatment.

9 Claims, 6 Drawing Sheets

INDUCTION SHAFT HEAT TREATMENT APPARATUS

FIELD OF THE INVENTION

This invention relates to heat treatment apparatus for a generally cylindrical shaft and, more particularly, to such heat treatment apparatus having means for substantially reducing warpage of the shaft during heat treatment thereof.

BACKGROUND OF THE INVENTION

Axle shafts of the type used in automotive vehicles are formed of high-carbon steel that is heat treated to increase strength. The treatment comprises inductively heating the steel above about 1750° F. and quickly water quenching. Because of the elongated shape of the shaft, this is conveniently carried out by longitudinally passing the shaft through a station that progressively treats the length of the shaft. The station includes an electrical coil that surrounds an axial zone of the shaft and inductively heats the zone by an alternating electrical current conducted through the coil. Thereafter, the heated zone passes through the quench ring that sprays cooling water onto the steel. As the shaft is passed through the station, it is held in a fixture that includes locators, referred to as centers (centering spindles), that hold the ends of the shaft and rotate the shaft to promote uniform heating and treatment.

A problem in the manufacture of axle shafts is the deviation of the axle axis from a straight line, which is referred to as warpage. Some warpage is found in the shaft prior to heat treatment as a result of the preceding operations. Furthermore, the heat treatment tends to produce warp in the shaft as a result of residual stresses introduced by the rapid heating and cooling sequence. To reduce warpage, the treated shaft is conventionally subjected to a cold straightening operation following heat treatment, which not only is costly, but may introduce cold working stresses into the metal that tend to weaken the shaft.

It is an object of this invention to provide an apparatus for induction heat treating an axle shaft or the like that reduces warpage in the treated shaft. The apparatus not only minimizes warpage that might otherwise result from the heat treatment operation, but also may lessen pre-existing warpage found in the shaft prior to treatment. It is a more particular object of the invention to provide a shaft heat treatment apparatus of the type having a heat treatment station that longitudinally scans a length of a steel shaft to progressively treat the shaft, which apparatus comprises at least one pair of opposing shaft support jaws at an axial zone intermediate the shaft ends that confine the shaft before and after the station to reduce warpage, but disengage the shaft for passage of the zone through the station for unencumbered heat treatment. The apparatus comprises a cam follower operatively connected to the support jaws that engages a cam arrangement at the station, causing the support jaws to bypass the station without colliding therewith, but permitting the jaws to re-engage the shaft prior to the setting of warpage therein.

SUMMARY OF THE INVENTION

In a preferred embodiment, the present invention contemplates a heat treatment apparatus, such as an induction hardening apparatus, of the type having a heat treatment station defining an axial path therethrough for progressively a shaft traveling longitudinally along the path. For treatment, the shaft is mounted in a fixture that not only includes center spindles that engage the shaft ends, but further includes at least one pair of support jaws supporting the shaft at an axial location intermediate the shaft ends in such a manner as to substantially reduce shaft warpage during heat treatment. Each support jaw is transversely movable between a first shaft-engagement position wherein the support jaw engages the shaft at the axial location to confine the shaft and a second transversely spread apart, open position where in the support jaw is spaced apart from the shaft to allow passage of the shaft location through the treatment station as the shaft is scanned thereby. The opposing support jaws are moved transversely to the first shaft-engagement positions by jaw biasing means that apply opposed, generally equal bias to the support jaws at each axial location to confine the shaft therebetween.

The heat treatment apparatus includes a cam/cam follower arrangement between the heat treatment station and each pair of support jaws for moving the support jaws from the shaft-engagement positions to the open positions as the support jaws approach the heat treatment station during shaft scanning. In particular, each support jaw includes a cam follower surface disposed in axial alignment with cam means disposed in proximity to the treatment station. The cam means engages the cam follower surface of each support jaw as it approaches the heat treatment station to urge the support jaws from the shaft-engagement position to the transversely spread apart, open position for bypassing the station without colliding therewith. After the axial shaft location previously engaged by the opened support jaws exits the station, the support jaws are allowed to return from the open position to the shaft-engagement position for re-engaging the axial shaft location.

In this way, the opposing support jaws confine the shaft therebetween at the axial shaft location both before and after the support jaws bypass the heat treatment station. The heat treatment apparatus of the present invention is effective to substantially reduce shaft warpage that might otherwise occur due to the heat treatment operation itself as well as any pre-existing warpage of the shafts as supplied to the heat treatment apparatus since the support rollers urge any warped heated shaft portion toward a preselected axis or centerline during treatment.

In one embodiment of the invention, the support jaws each include a shaft-engaging roller mounted thereon for rotation in response to engagement with the rotating shaft while the shaft is confined therebetween. The shaft-engaging rollers minimize friction between the support jaws and the shaft when the support jaws are in the shaft-engagement positions.

In another embodiment of the invention, each support jaw includes a cam follower surface located in axial alignment with a cam surface disposed in proximity to the treatment station. Each cam surface includes a first, transversely diverging surface portion for urging the support jaw transversely from the shaft-engagement position toward the open position, a second surface portion that is generally parallel with the shaft axis for establishing the open position of each support jaw and a third, transversely converging surface portion for allowing return of the support jaw from the open position to the shaft-engagement position by the biasing means.

In another embodiment of the invention, the biasing means comprises a pneumatic spring operatively connected to each support jaw to bias the support jaw to the shaft-engagement position both before and after the support jaw bypasses the treatment station.

The aforementioned objects and advantages of the present invention will become more readily apparent from the following detailed description and drawings.

DETAILED DESCRIPTION OF CERTAIN EMBODIMENTS OF THE INVENTION

Figure 1:
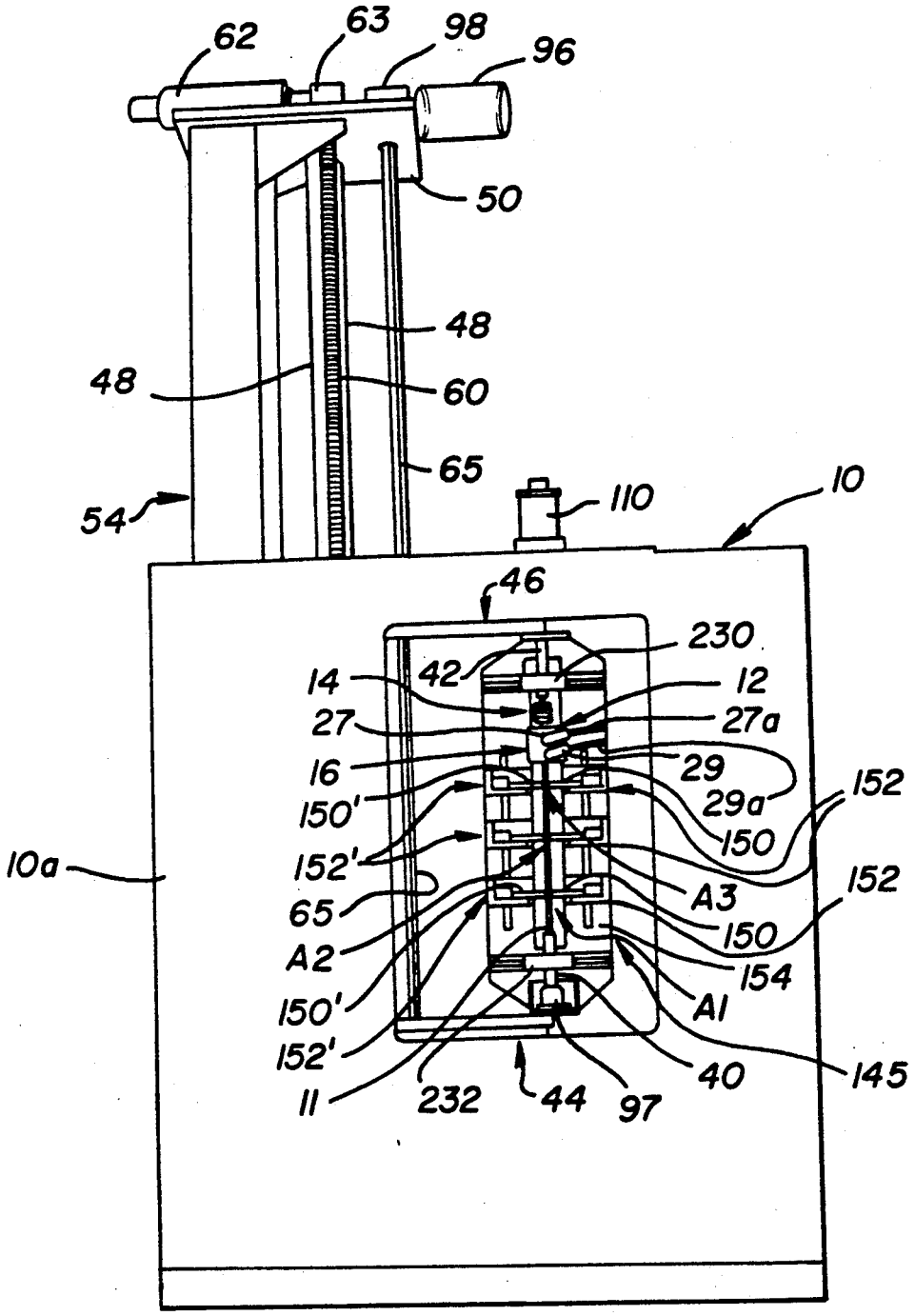
FIG. 1 is an elevation of a heat treatment apparatus in accordance with the invention.
Figure 2:
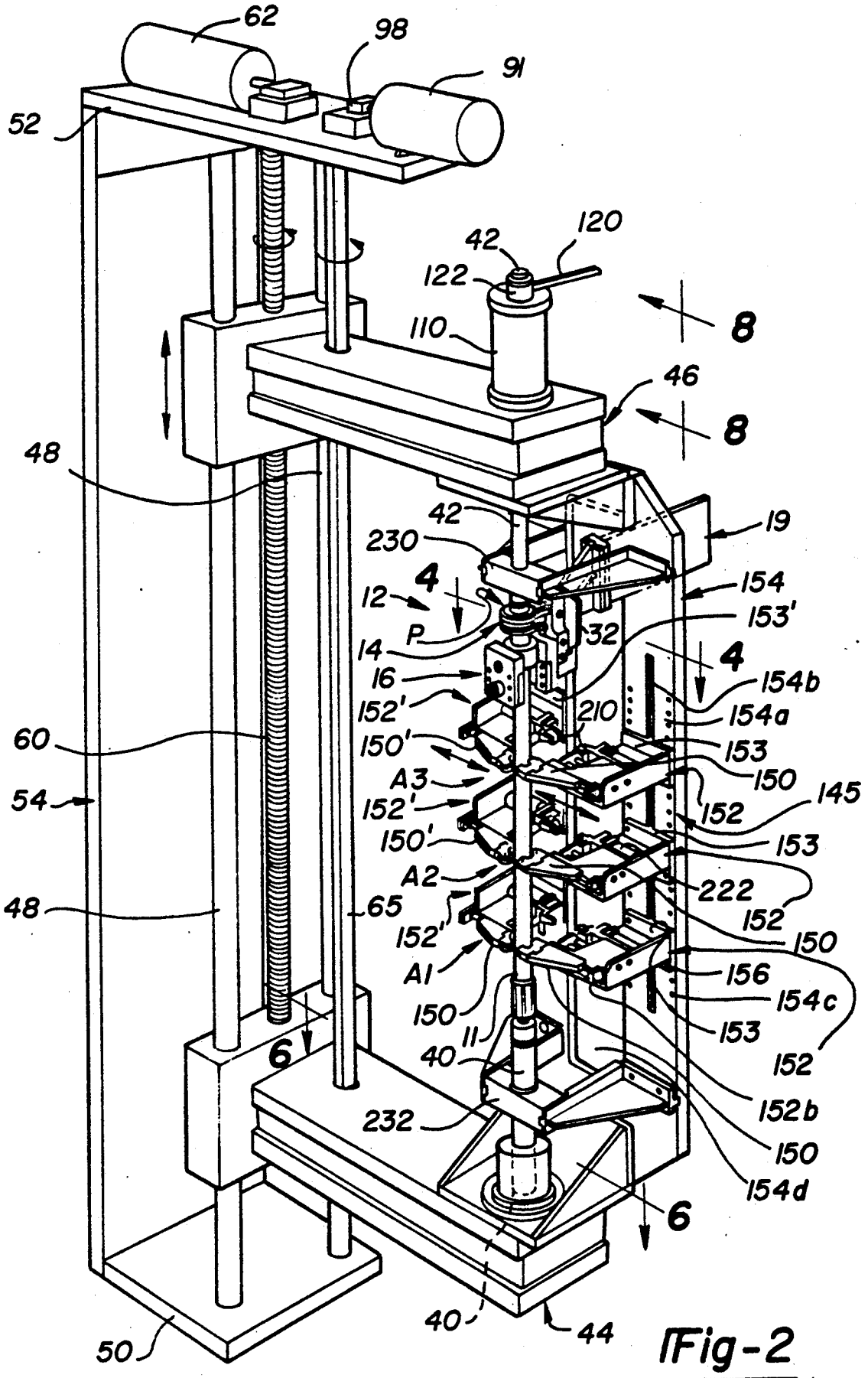
FIG. 2 is a perspective view of the shaft support fixture and the heat treatment station for induction hardening an axle shaft.

Referring to FIGS. 1 and 2, a heat treatment apparatus 10 is shown for progressively induction hardening axial zones of a steel axle shaft 11 which typically has splined upper and lower ends (only splined lower end shown). In particular, the apparatus 10 includes an enclosure 10*a* in which a heat treatment station 12 is disposed for scanning the length of the shaft 11 while the shaft 11 is rotated about its longitudinal axis. As will be explained in more detail hereinbelow, the heat treatment station 12 is disposed in a fixed axial position and is caused to scan the shaft length by movement of the shaft 11 downwardly through an axial path P extending through the heat treatment station 12. The heat treatment station 12 scans the shaft 11 until a desired length thereof has been inductively hardened.

Figure 3:
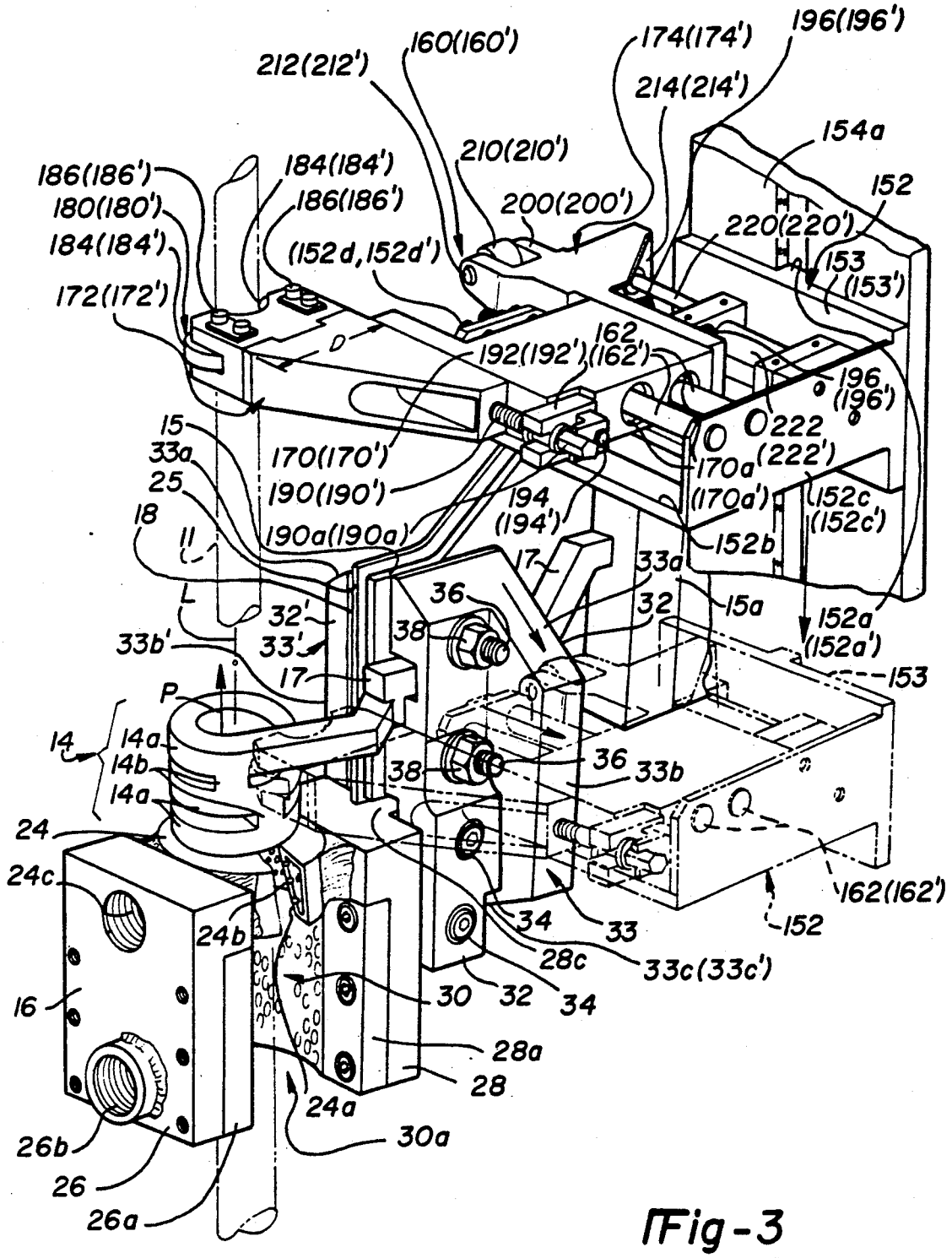
FIG. 3 is a fragmentary, enlarged perspective view of the heat treatment station and a support jaw shown in the shaft-engagement position (in solid lines) and in the open position (in phantom lines).

Referring to FIGS. 1-5, the heat treatment station 12 comprises an induction coil 14 and an axially juxtaposed quench head 16 that inductively heat and quench successive axial zones of the shaft 11 as it travels along the path P through the station 12. In particular, the induction coil 14 comprises one or more copper induction rings 14*a* (e.g., three induction rings shown) interconnected by upstanding upper posts 14*b* (FIG. 3). The induction rings 14*a* are hollow and are provided with aqueous coolant via hollow, copper buss arms 17, 22. The uppermost ring 14*a* is fixedly attached to a copper buss plate 15 by the hollow copper buss arm 17 while the lowermost ring 14*a* is attached to a copper buss plate 18 by a similar copper buss arm 22 (see FIGS. 4-5). The buss plates 15, 18 are electrically insulated from one another by an intermediate plastic, electrical insulating member 25. The buss plates 15, 18 include respective buss bar flanges 15*a*, 18*a* which are fastened to respective buss bar flanges 19*a*, 19*b* of a stationary electrical buss assembly 19 exiting from an A.C. electrical transformer (not shown). The induction coil 14 is thereby held in a fixed axial position concentric with the longitudinal axis defined by centering spindles 40, 42 to be described and is electrically energized by the buss assembly 19, buss arms 17, 22 and buss plates 15, 18.

The quench head 16 comprises a central, hollow annular ring 24 spaced axially below and concentric with the shaft axis and a pair of hollow side members 26, 28 welded to the ring 24 (FIG. 3). The ring 24 includes an annular inner, frusto-conical surface 24*a* defining a central, quench chamber 24*b* concentric to the shaft axis. The ring surface 24*a* includes a plurality of coolant discharge apertures for directing coolant onto the portion of the shaft 11 traveling through the quench chamber along the path P. Coolant is supplied to the ring 24 via a fitting 27 (FIG. 1) connected to the threaded port 24*c* and a hose 27*a* extending from the fitting 27 to a coolant source (not shown). The side members 26, 28 define an axially elongated second quench chamber 30 therebetween and include apertured inserts 26*a*, 28*a* thereto for discharging aqueous coolant onto the portion of the shaft 11 traveling along path P through the quench chamber 30. Coolant is supplied to each side member 26, 28 from the aforementioned source (not shown) via a respective fitting (only fitting 29 shown in FIG. 1) threaded to a threaded port on each side member 26, 28 (only threaded port 26*b* shown in FIG. 3) and a hose (only hose 29*a* shown) extending from the respective fitting to the source.

Referring to FIG. 3, the side member 28 includes a flange 28*c* which is clamped between identical cam members 32, 32' using fasteners 34. The cam members 32, 32' are, in turn, clamped to the copper buss plates 15, 18 by bolts 36 and nuts 38. The cam members 32, 32' are made of electrical insulating material so as to electrically insulate the metal (e.g., aluminum) quench head 16 from the copper buss plates 15, 18.

As mentioned hereinabove, the heat treatment station 12 is caused to scan the shaft 11 by moving the shaft 11 along the path P through the stationary heat treatment station 12 as the shaft 11 is rotated. To this end, the apparatus 10 includes axially spaced apart, opposing lower and upper centering spindles 40, 42 between which the lower and upper ends of the shaft 11 are engaged. The lower and upper ends of the shaft 11 have pilot centers machined therein to receive the centers 40, 42 and establish therewith a longitudinal axis L or centerline therebetween toward which the shaft 11 is to be strengthened.

The centering spindles 40, 42 are rotatably mounted on lower and upper lateral support members 44, 46. The support members 44, 46 are mounted for vertical movement on a pair of upstanding guide rods 48 fixedly disposed between lower and upper frame support plates 50, 52 of the stationary C-shaped frame 54, FIG. 2. The support members 44, 46 are moved vertically by means of a ball screw 60 that drivingly engages a ball nut (not shown) disposed in each support member 44, 46. The ball screw 60 is driven to rotate by an electrical or other motor 62 and gear reducer 63 disposed atop the upper frame support plate 50. Rotation of the ball screw 60 in one direction causes the support members 44, 46 to be raised in unison while rotation in the opposite direction causes the support members 44, 46 to be lowered in unison.

Figure 6:
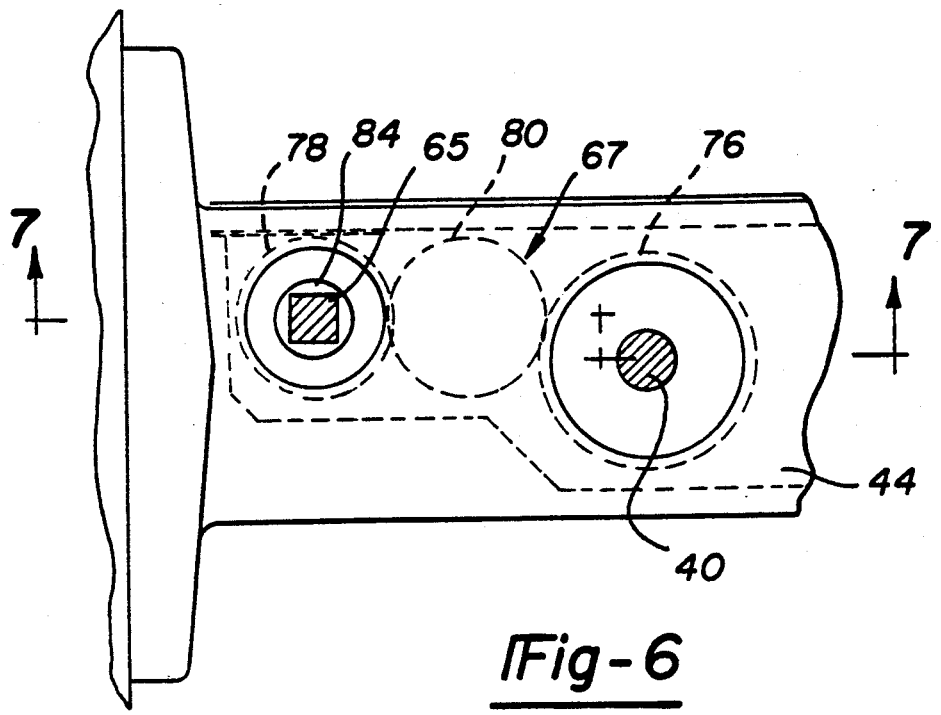
FIG. 6 is a fragmentary view taken along lines 6—6 of FIG. 2.
Figure 7:
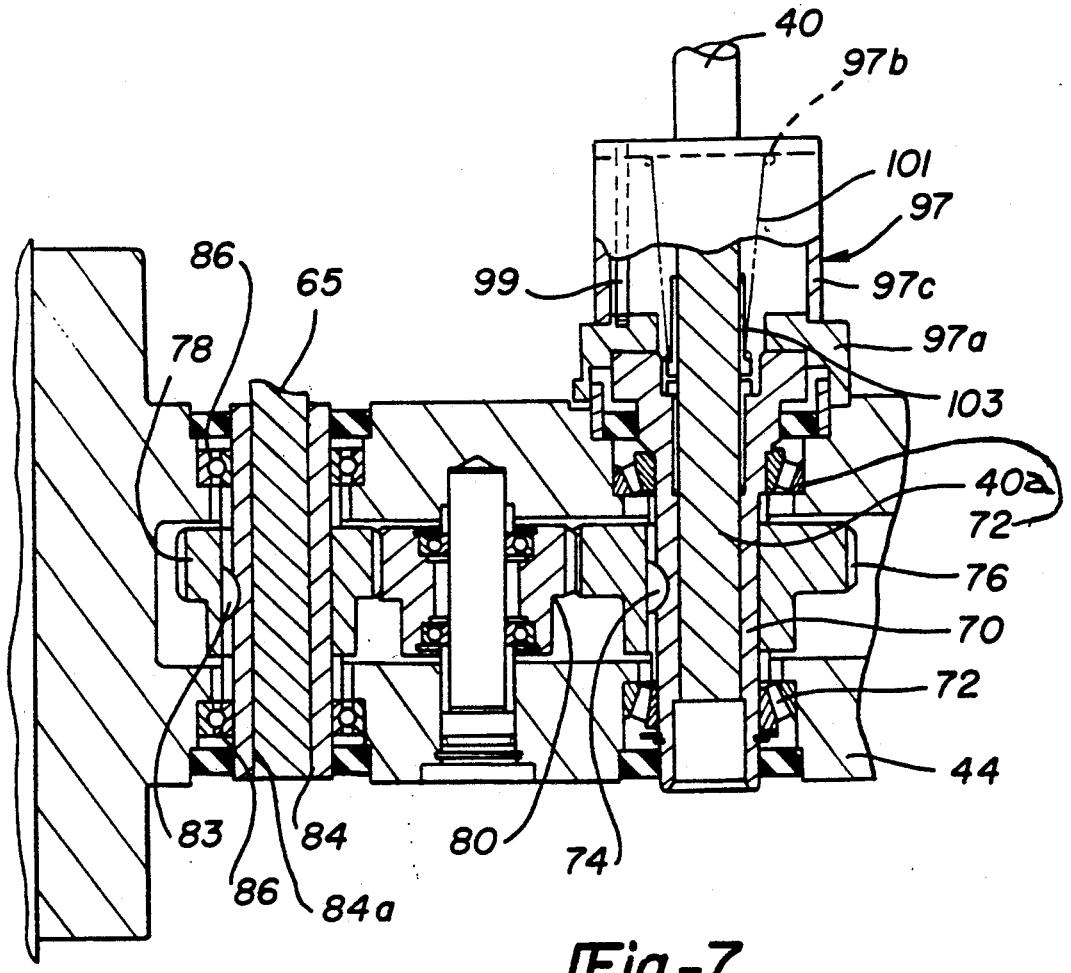
FIG. 7 is a cross-sectional view taken along lines 7—7 of FIG. 6.

The axially opposing centering spindles 40, 42 are driven in rotation on the respective support arms 44, 46 by a common drive shaft 65 and a gear train 67, 69 on the respective support members 44, 46. For example, referring to FIGS. 6 and 7, the lower center 40 includes a lower end 40*a* in an elongated sleeve 70 that is rotatably mounted on the support member 44 via anti-friction bearings 72. The sleeve 70, in turn, is keyed (by key 74) to a driven pinion gear 76. Pinion gear 76 is driven in rotation by drive gear 78 through an idler gear 80. The drive gear 78 is keyed (by key 83) to an elongated sleeve 84 mounted on the support member 44 by bearings 86. The sleeve 84 has a square cross-section internal passage 84*a* for receiving the square cross-section drive shaft 65. Drive shaft 65 is driven in rotation by electrical motor 96 and gear reducer 98 disposed atop frame support plate 50, FIGS. 1–2.

A cylindrical housing or cover 97 is connected to the sleeve 70 for rotation therewith. The housing 97 includes a lower plate 97*a*, upper plate 97*b* having a center-engaging seal (not shown) and a cylindrical wall 97*c* held together by a plurality of circumferentially spaced threaded rods 99 (only one shown). A compression spring 101 is disposed between the upper plate 97*b* and an annular spring retainer sleeve 103 that bears on the center 40 for biasing the center 40 downwardly in the sleeve 70. Although not shown in FIG. 7, a drive pin is provided on upper plate 97*b* to reside in an axially elongated slot in the center of spindle 40 to couple the sleeve 70 and center 40 for rotation together while allowing vertical sliding of the center 40 relative to the sleeve 70 (e.g., see FIG. 8 for a similar anti-rotation pin 110*e* and spindle slot 42*a*).

Figure 8:
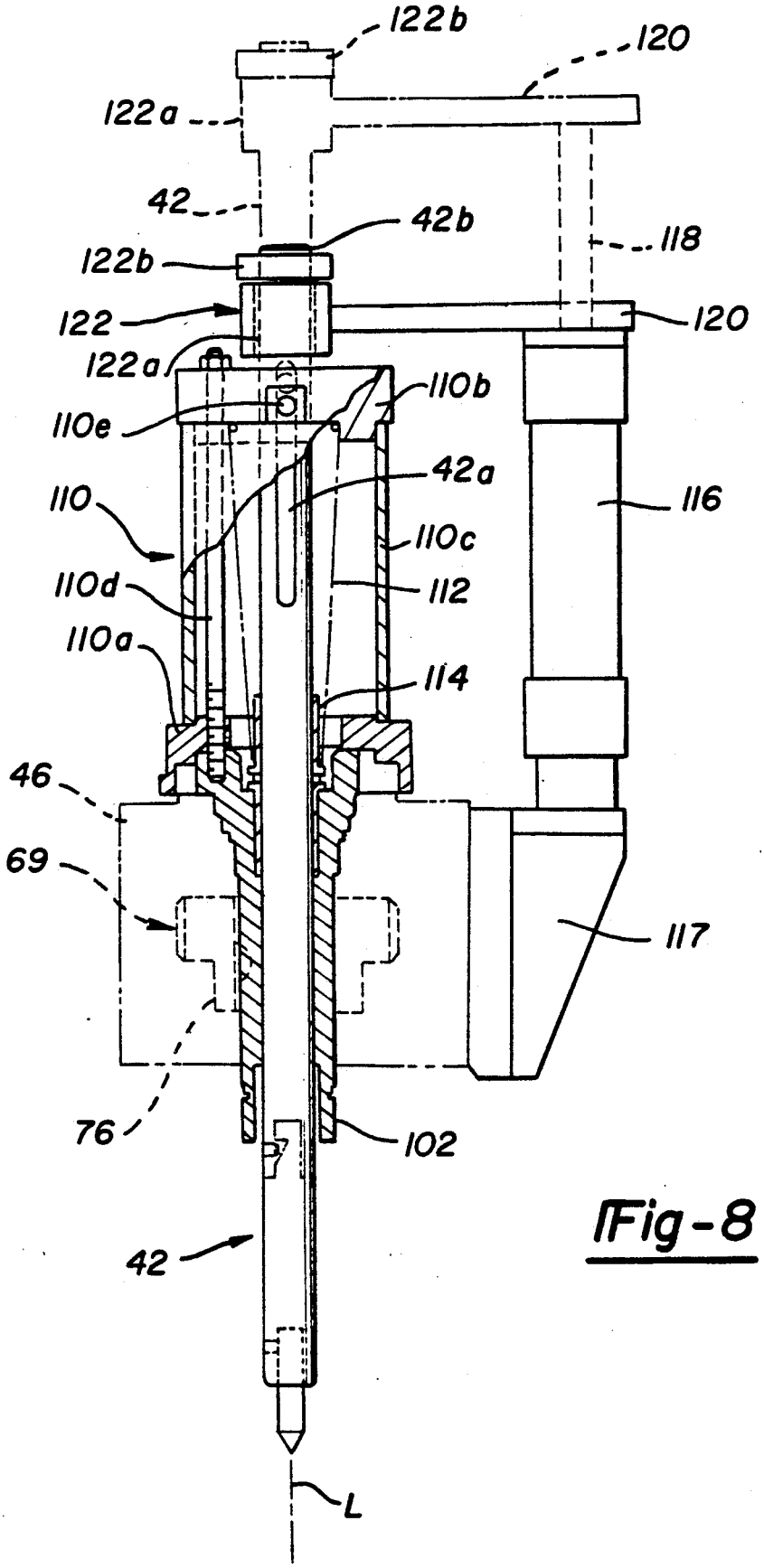
FIG. 8 is a view taken along lines 8—8 of FIG. 2.

Referring to FIG. 8, the upper centering spindle 42 is received in an elongated sleeve 102. The sleeve 102 is rotatably mounted and driven on the support arm 46 by a gear train 69 (only one gear thereof shown) similar to gear train 67 shown in FIG. 7 for rotating sleeve 70. The upper and lower centering spindles 40, 42 are rotated in unison by the drive shaft 65 so as to rotate the shaft 11 during heat treatment thereof by the heat treatment station 12.

The upper centering spindle 42 is also vertically slidable in the sleeve 102 to permit raising and lowering of the upper center 42 to accommodate loading of a shaft 11 between the centering spindles 40, 42. In particular, referring again to FIG. 8, the sleeve 102 is connected to a cylindrical housing or cover 110 having a lower plate 110*a*, upper plate 110*b* having a center-engaging seal (not shown) and cylindrical wall 110*c* held together by a plurality of circumferentially spaced threaded rods 110*d* (only one shown). A compression spring 112 is disposed between the upper plate 110*a* and an annular spring retainer sleeve 114 bearing on the center 42 as shown best in FIG. 8. The spring 112 functions to bias the centering spindle 42 downwardly into engagement with the upper end of the shaft 11 (see FIG. 2). A drive pin 110*e* on the upper plate 110*b* resides in an elongated slot 42*a* in the centering spindle 42 to couple the sleeve 102 and center 42 for rotation together while allowing vertical movement of the center 42 relative to the sleeve 102.

To effect loading of a shaft 11 between the centering spindles 40, 42, the spindle 42 is raised to an upper load position by a fluid (pneumatic) cylinder 116 having a piston 118 connected to an actuator arm 120. The cylinder 116 is mounted on a support frame 117 attached to support member 46 for movement therewith. Actuator arm 120, in turn, is connected to an end cap 122 disposed about the upper spindle end 42*b*. The end cap 122 includes axially movable collar 122*a* and clamp plates 122*b* clamped fixedly to the spindle end 42*b*. When the cylinder 116 is actuated to extend its piston 118, the actuator arm 120 is raised and raises the 122*a* to urge the clamp plates 122*b* and spindle 42 upwardly to the load position shown in phantom lines in FIG. 8. This load position of the center 42 allows loading of the shaft 11 between the centers 40, 42.

After the shaft 11 is loaded between the centering spindles 40, 42, the cylinder 116 is actuated to retract its plunger 118. The compression spring 112 then biases the spindle 42 downwardly into engagement with the upper end of the shaft 11 as shown in FIGS. 1–2. Both the upper and lower spindles 40, 42 include pointed conical ends for mating in similar conical recesses formed in the upper and lower ends of the shaft 11. The use of conical ends/recesses facilitates accurate centering of the shaft ends relative to the longitudinal axis L defined between the opposing centers 40, 42.

In accordance with the invention, a shaft support fixture 145 is provided to support the loaded shaft 11 at a plurality of spaced apart axial locations A1, A2, A3 intermediate the upper and lower ends of the shaft as the shaft travels along the path P through the heat treatment station 12 during the heat treatment thereof. In particular, a pair of identical opposing support jaws 150, 150' is disposed on the fixture 145 at each axial location A1, A2, A3. Since the support jaws 150, 150' of each pair are identical except for orientation, the various like components thereof will be designated by the same reference numerals, the reference numerals for support jaw components on one side of the shaft 11 being unprimed and those for support jaw components on the other side of the shaft 11 being primed. As shown best in FIGS. 2–5, each support jaw 150, 150' is mounted on an L-shaped support bracket 152, 152'. The bracket 152, 152' includes a rear mounting plate 153, 153' fastened to an elongated support fixture plate 154. The fixture plate 154 is fastened between the support arms 44, 46 as shown best in FIG. 2 by suitable fasteners for movement in unison therewith. The fixture plate 154 includes upstanding sides 154*a*, 154*a'* having a vertical slot 154*b*, 154*b'* to receive a mounting plate key 152*a*, 152*a'* of each bracket 152, 152'. Moreover, each side 154*a*, 154*a'* includes a series of threaded holes (only holes 154*c* shown) to receive fasteners 156, 156' for fastening the brackets 152, 152' in a selected axial position thereon depending upon the length of the shaft 11 being induction hardened.

Although the brackets 152, 152' are shown including a bottom plate 152*b*, 152*b'* and an upstanding side plate 152*c*, 152*c'* with the support jaws 150, 150' disposed atop the bottom plate 152*b*, 152*b'*, those skilled in the art will appreciate that L-shaped brackets like those on the right side 154*a* of the fixture plate 154 in FIGS. 1–2 can simply be inverted and fastened to the left-side 154*a*, thereof to provide a pair of support jaws 150, 150' at each axial location A1, A2, A3 and thereby eliminate the need to fabricate two different sets of the brackets 152, 152'. However, for purposes of clarity, the brackets 152, 152' are illustrated in the FIGS. 1–5 as having the support jaw 150, 150' disposed atop a bottom plate 152*b*, 152*b'* of the bracket 152, 152'.

The fixture plate 154 includes an elongated, central, vertical opening 154*d* configured to receive the buss assembly 19 and permit axial movement of the fixture plate 154 relative thereto.

Figure 4:
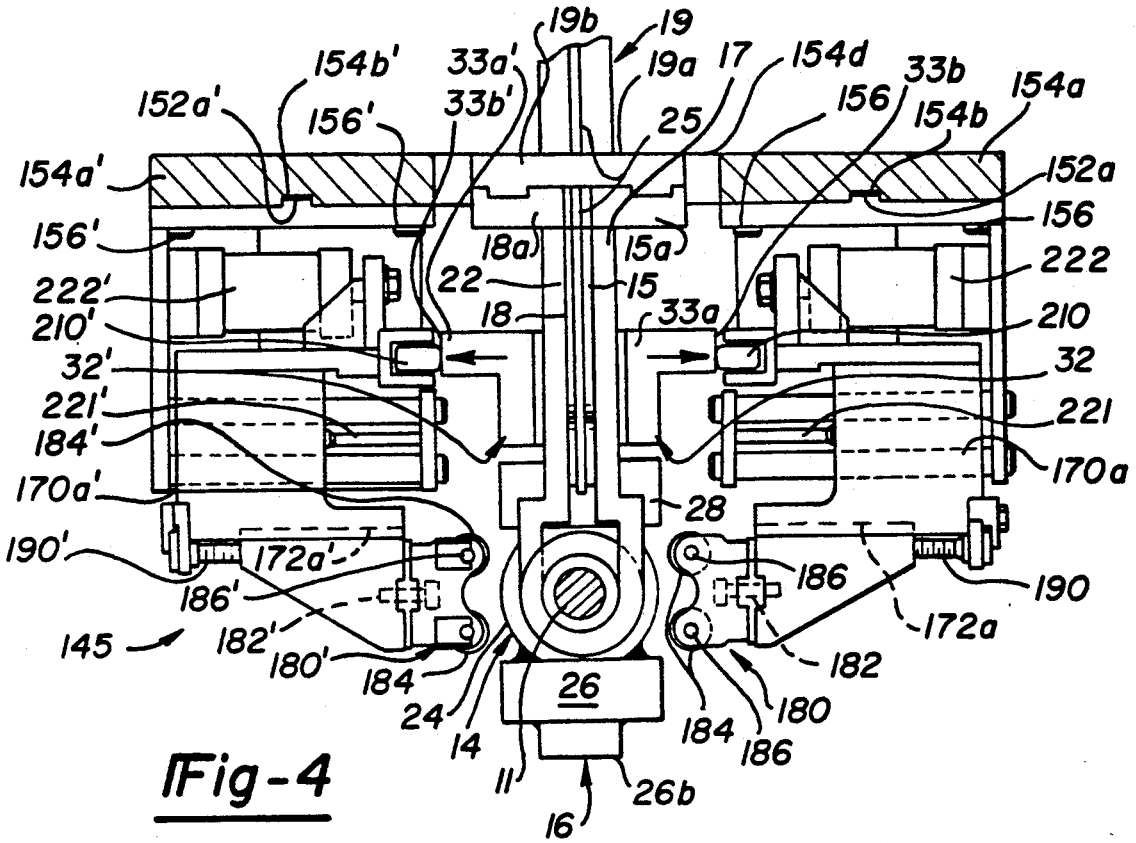
FIG. 4 is a view taken along lines 4—4 of FIG. 2 showing the opposing support jaws in the open positions as the shaft location engaged thereby travels through the induction coil.
Figure 5:
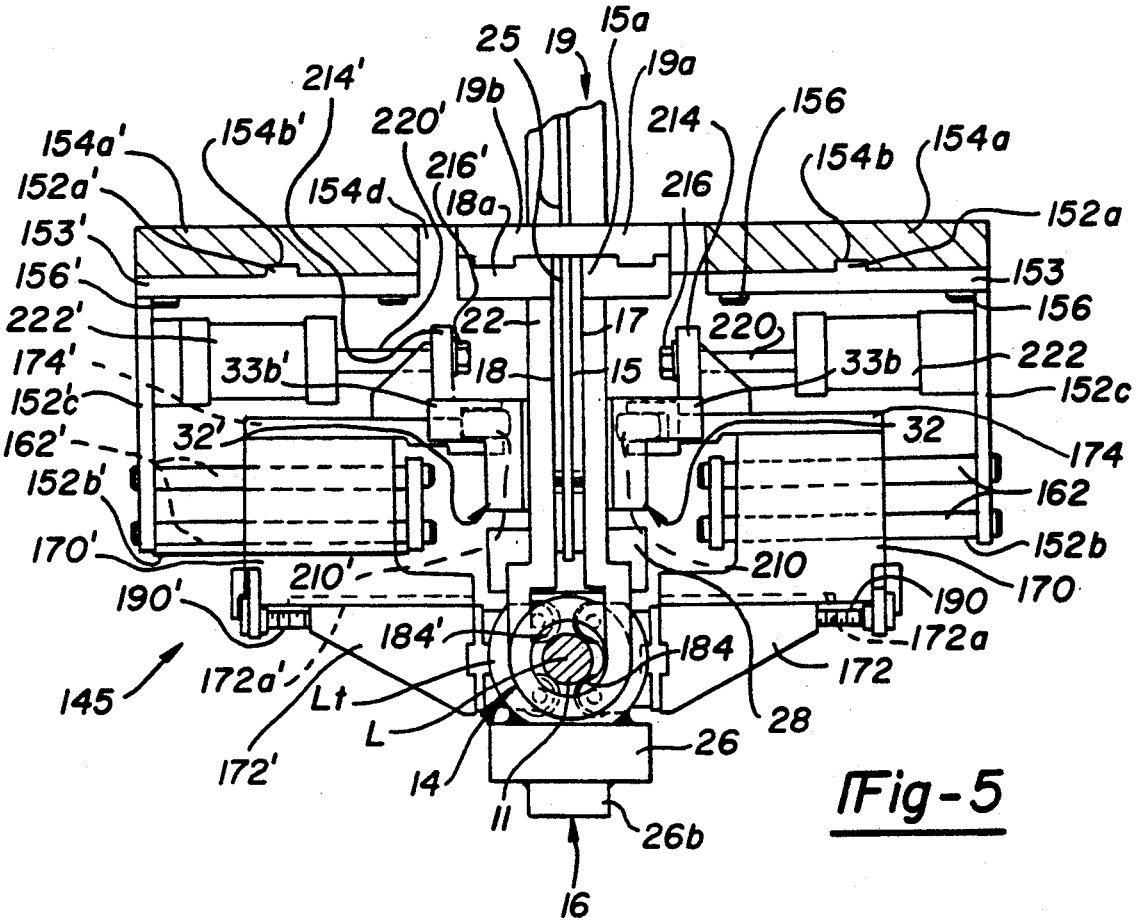
FIG. 5 is a view similar to FIG. 4 showing the opposing support jaws in the shaft-engagement positions after the shaft location engaged thereby exits the induction coil.

As shown best in FIGS. 3-5, each support jaw 150, 150' includes a 3-part body 160, 160' mounted on a pair of horizontal, parallel guide rods 162, 162' for movement transversely of the longitudinal axis L defined between the centering spindles 40, 42. The guide rods 162, 162' have longitudinal axes that are perpendicular to the longitudinal axis defined between the centers 40, 42 to this end. The rods 162, 162' are fixedly mounted between the spaced apart plates for flanges 152c, 152c' and 152d, 152d' on the bracket 152, 152'.

Each support jaw body 160, 160' includes a central portion 170, 170' that is mounted on the guide rods 162, 162'. In particular, each central portion 170, 170' includes internal linear bushings 170a, 170a' for receiving the guide rods and permitting sliding of the support jaw 150, 150' thereon.

Each support jaw body 160, 160' also includes a shaft support body portion 172, 172' and a cam follower body portion 174, 174' mounted on opposite sides of the central body portion 170, 170'. The support body portion 172, 172' is slidably mounted on the central body portion 170, 170' by a gibb 172a, 172a' on the former received in a corresponding groove 170a 170a' in the latter, FIGS. 4-5. The support body portion 172, 172' has a shaft support roller assembly 180, 180' fastened thereto by a fastener 182, 182' (FIG. 4). The roller assembly 180, 180' comprises a pair of shaft contacts such as support rollers 184, 184' circumferentially spaced apart on a circle of given diameter corresponding to the diameter of the shaft 11. Each support roller or contact 184, 184' is rotatable about a pin 186, 186' in response to engagement with the rotating shaft 11 as will become apparent hereinbelow. The pins 186, 186' define roller rotational axes that are parallel to the longitudinal axis L defined between the centers 40, 42. The roller assembly 180, 180' is a low friction roller assembly available from McGill Manufacturing Co., Inc. Valparaiso, Ind.

The lateral dimension D of the roller assembly 180, 180' is selected so as to fit with clearance in the access slots 30a to quench chamber 30 formed between the side members 26, 28 of the quench head 16 for purposes to be explained.

An adjustment screw 190, 190' is threaded into the support body portion 172, 172' at one end and includes an enlarged screw head 190a, 190a' that abuts a clevis stop 192, 192' fastened on the central body portion 170, 170' (by fastener 194, 194'). The screw 190, 190' is used to adjust the position of the support body portion 172, 172' relative to the central body portion 170, 170' for purposes to be described hereinbelow.

The cam follower body portion 174, 174' is fixedly attached to the central body portion 170, 170' by fasteners 196, 196' (FIG. 3). The cam follower body portion 174, 174' includes a clevis extension 200, 200' for supporting a cam follower roller 210, 210' for rotation on pin 212, 212'. Pin 212, 212' provides a horizontal rotational axis for the cam follower roller 210, 210'. The cam follower body portion 174, 174' also includes a depending flange 214, 214' that is connected to a support jaw biasing means comprising a plunger or piston 220, 220' and a fluid (e.g., pneumatic) cylinder 222, 222'. In particular, the flange 214, 214' is connected to the plunger 220, 220' by fastener 216, 216' (FIG. 5). Extension of the plunger 220, 220' moves the support jaw 150, 150' transversely toward the longitudinal axis L to a shaft-engagement position (FIG. 5) whereas retraction of the plunger 220, 220' moves the support jaw 150, 150' to a retracted position (similar to the open position shown in FIG. 4). The cylinder 222, 222' is actuated by relatively low (e.g., 15-20 psi) air pressure so that it functions as a pneumatic spring for purposes explained hereinbelow.

As shown best in FIG. 2, the fixture plate 154 also includes upper and lower center support brackets 230, 232 having suitable bushings for rotatably receiving the respective spindles 40, 42 and supporting the spindles 40, 42 to resist deflection off the longitudinal axis L defined therebetween during operation of the apparatus 10. The brackets 230, 232 maintain the spindles 40, 42 within a precise preselected runout tolerance.

In operation of the heat treatment apparatus 10, a shaft 11 is loaded between the centering spindles 40, 42 when the support members 44, 46 are in the lower position shown in FIG. 2. During loading of the shaft 11, the support jaws 150, 150' are positioned (by cylinder 222, 222') in the initial retracted position (similar to the open position shown in FIG. 4) remote from the longitudinal axis L. Once the shaft 11 is loaded on the support fixture 145, the support members 44, 46 are moved upwardly by rotating the ball screw 60 to position the fixture 145 and the shaft 11 thereon at a preselected scan start position above the heat treatment station 12. The particular scan start position used is dependent on the particular shaft 11 to be treated. The support jaws 150, 150' are in the retracted positions at this time.

Once the shaft 11 is positioned at the scan start position above the station 12, the cylinder 222, 222' is actuated to extend its plunger 220, 220' to a maximum stroke length (as determined by adjustable stop screw 221, 221' shown in FIG. 4) to move the support jaws 150, 150' to the shaft-engagement positions shown in solid lines in FIGS. 3 and 5 wherein the rollers 184, 184' are in engagement with the shaft 11 at the axial locations A1, A2, A3.

The shaft-engagement positions are preset using a first "reference" shaft 11 in a series of like shafts of the same diameter to be induction hardened. In particular, after the first shaft 11 is loaded between the centering spindles 40, 42' the cylinder 222, 222' is actuated to extend its plunger 220, 220' to the aforesaid maximum stroke length to move the rollers 184, 184' (contacts) against the shaft 11 at each axial location A1, A2, A3. The adjustment screw 190, 190' is then rotated to finely adjust the position of the rollers 184, 184' so that they just meet (engage) the shaft 11 at the axial locations A1, A2, A3. In this adjusted position, opposed, generally equal bias is applied to the support jaws 150, 150' by the cylinder 222, 222'. This initial adjustment procedure sets the support jaws 150, 150' at the desired shaft-engagement positions which are then repeated for the remaining shafts 11 of the same series to be induction hardened using the apparatus 10. When shafts 11 of a different diameter are to be induction hardened, the supporting jaws 150, 150' are readjusted to the appropriate shaft-engagement positions using the above-described procedure. When shafts 11 of a different length are to be induction hardened, the spindles 40, 42 are replaced with those of appropriate length.

After the shaft 11 reaches the start scan position, the support jaws 150, 150' are moved transversely by cylinders 222(222') to the pre-set shaft-engagement positions and the drive shaft 65 is rotated by motor 96 to rotate the spindles 40, 42 and thus the shaft 11. The induction coil 14 is energized and coolant is supplied to the quench head 16. Thereafter, the support members 44, 46 are moved downwardly at a predetermined rate (e.g., one inch per second) to convey the fixture 145 downwardly to cause the shaft 11 to travel downwardly along the path P through the heat treatment station 12.

As the fixture 145 and the shaft 11 are conveyed downwardly toward the heat treatment station 12, each pair of support jaws 150, 150' successively will approach the cam members 32, 32' fastened on buss plates 15, 18. The cam members 32, 32' include the cam surfaces or tracks 33, 33' which are in axial alignment with the cam follower rollers 210, 210' so as to engage therewith.

In particular, the cam tracks 33, 33' include a first downwardly, transversely diverging surface portions **33*a*, 33*a'* that, upon engagement with the respective cam follower rollers 210, 210' urges them transversely of the longitudinal axis L to move the support jaws 150, 150' from the shaft-engagement positions (see solid lines in FIG. 3) toward open positions (see phantom lines in FIG. 3 and solid lines in FIG. 4) wherein the support jaws will bypass the heat treatment station 12. In particular, the diverging track surface portions 33*a*, 33*a'* are located axially to allow the support jaws 150, 150' to urge the support jaws 150, 150' toward the open positions as they approach the induction coil 14, e.g., see FIG. 3. Camming of the support jaws 150, 150' from the shaft-engagement positions toward the open positions is in opposition to the opposed, generally equal bias applied on the support jaws 150, 150' by the cylinders 222, 222'**.

As the shaft 11 continues to move downwardly along the path P through the station 12, the cam follower rollers 210, 210' will next engage a second cam surface portion **33*b*, 33*b'* that is parallel with the longitudinal axis L to establish the open positions of the support jaws 150, 150' wherein they avoid colliding with the induction coil 14 (see phantom lines in FIG. 3). The axial length of the second surface portion 33*b*, 33*b'* is selected to maintain the support jaws 150, 150' in the open positions until the particular axial location A1, A2 or A3 engaged by the support jaws exits the induction coil 16. Thereafter, the support jaws 150, 150' can be returned to the shaft-engagement positions in the quench chamber 30 (i.e., in the slots defined between the side members 26, 28) without colliding with the coil 16. To this end, the cam tracks 33, 33' include a third downwardly, transversely converging surface 33*c*, 33*c'* that allows the support jaws 150, 150' to be returned to the shaft-engagement positions (FIG. 5) by the opposed, generally equal bias applied thereon by cylinders 222, 222'**.

Each pair of support jaws 150, 150' is thereby caused to bypass the heat treatment station 12 as the axial location A1, A2, A3 engaged thereby travels through the induction coil 16 and then to re-engage the shaft 11 as the axial location exits the induction coil 14 in the quench chamber 30.

Downward movement of the fixture 145 and thus the shaft 11 is continued until the support members 44, 46 reach the original shaft load position, FIG. 2, below the heat treatment station 12. However, once the desired shaft length is induction hardened, the induction coil 14 is de-energized while coolant continues to be supplied to the quench head 16 until the support members 44, 46 reach the original shaft load position.

Once the fixture 145 and the shaft 11 reach the shaft load position (FIG. 2), coolant flow to the quench head 16 is discontinued and all of the support jaws 150, 150' are moved to the retracted positions (similar to the open positions of FIG. 5) by cylinders 222, 222'. The induction hardened shaft 11 can then be removed from between the spindles 40, 42 by raising of the upper spindle 42 (using cylinder 116). An untreated shaft 11 (supplied from a wire blanking operation) is then loaded between the spindles 40, 42 for induction hardening in the manner described hereinabove.

Use of the plurality of pairs of support jaws 150, 150' to engage the shaft 11 at axial locations A1, A2, A3 both before and after the support jaws bypass the heat treatment station 12 results in a substantial reduction in warpage of the shaft 11 during the induction hardening operation. In particular, in induction hardening trials using the heat treatment apparatus 10 to induction harden axle shafts in the range of 0.9 inch to 1.3 inch in diameter and up to 30 inches in length, the induction hardened shafts all were measured to be well within the prescribed tolerance for the particular axle shafts involved. In particular, the shafts were measured to be to within 0.025 inch TIR when induction hardened using the apparatus 10 regardless of whether the shafts 11 were initially supplied within or outside the specified TIR tolerance (0.049 inch TIR) from a wire blanking operation. Importantly, axle shaft that exhibited preexisting warpage as supplied from the wire blanking operation were actually straightened when heat treated using the heat treatment apparatus 10. As a result, the need to subsequently cold work the induction hardened axle shafts to straighten them was eliminated.

These benefits are obtained with no sacrifice in production rate. As a result, the overall cost of manufacturing induction hardened axle shafts within the prescribed tolerance is significantly reduced.

Moreover, although the heat treatment apparatus 10 has been illustrated hereinabove with respect to a stationary heat treatment station 12 and a moving shaft support fixture 145, the invention is not so limited. For example, the heat treatment station 12 may be movable relative to a stationary shaft support fixture 145.

Moreover, while the invention has been described in terms of specific embodiments thereof, it is not intended to be limited thereto but rather only to the extent set forth hereafter in the claims which follow.

The embodiments of the invention in which an exclusive property or privilege is claimed are defined as follows:

1. A shaft heat treatment apparatus for treating a generally cylindrical shaft rotated about a longitudinal axis by progressively treating axial zones of the shaft, said apparatus comprising:

(a) a heat treatment station sized and shaped for treating an axial zone of the shaft and having a path for travel of the shaft longitudinally through said station, (b) a fixture for supporting the shaft for relative travel along said path through said heat treatment station, said fixture comprising at least one pair of support jaws for supporting said shaft at an axial location intermediate the shaft ends, each said jaw being transversely movable between a first, shaft-engagement position and a second, open position wherein said jaw is spaced apart from the shaft to allow unencumbered passage of the shaft location through the treatment station, each said support jaw including a contact for engaging the shaft while accommodating rotation thereof, biasing means for urging the support jaw into the shaft-engagement position, and a cam follower surface for receiving a force opposite to said bias for moving said support jaw from said shaft-engagement position to said open position, said jaws being arranged in transversely opposed relationship for confinement of the shaft therebetween, (c) means for relatively axially moving said station and said fixture to convey a shaft along said path through said station, and (d) cam means disposed in proximity to said station in axial alignment with each said fixture cam follower surface for engaging said cam follower surface as said support jaw approaches said station to urge the support jaws from said shaft-engagement position to the open position to transversely spread the support jaws to bypass said station without colliding therewith and thereafter allow return of the support jaws from the open position to the shaft-engagement position to cause said shaft-engaging means to re-engage the shaft location after said shaft location exits said station for supporting the shaft following treatment, whereby the opposing support jaws confine the shaft therebetween at said axial location both before and after said support jaws bypass said station to thereby substantially reduce warpage of the shaft during heat treatment thereof.

2. The apparatus of claim 1 wherein said fixture comprises a pair of said support jaws at each of a plurality of axial locations intermediate the shaft ends.

3. The apparatus of claim 1 wherein said contact means comprises a roller rotatable about an axis parallel to the shaft longitudinal axes and adapted to be urged against the shaft and to rotate in response to rotation of the shaft to support the shaft at said location without encumbering the rotation thereof.

4. The apparatus of claim 1 wherein said biasing means comprises a pneumatic spring.

5. The apparatus of claim 1 wherein said cam means comprises a first surface portion in axial alignment with said cam follower surface in said shaft-engagement position and transversely diverging for urging the support jaw from the shaft-engagement position toward the open position as the axial location engaged thereby approaches said station, a second surface portion parallel with the shaft axis for establishing said open position while said axial location travels through said station and a third, transversely converging surface portion for allowing the support jaw to return to the shaft-engagement position after said axial location exits said station.

6. The apparatus of claim 1 wherein the heat treatment station comprises an induction coil and a quench chamber spaced axially therefrom along said path.

7. The apparatus of claim 6 including an electrically conductive buss member for supporting the induction coil in a fixed axial position.

8. The apparatus of claim 7 wherein said cam means comprises an electrically insulating cam member mounted on said buss member in proximity to said coil.

9. The apparatus of claim 1 including axially opposing centers for engaging opposite ends of said shaft and means for rotating the centers to rotate said shaft about its longitudinal axis.

* * * * *